United States Patent [19]

Johnson

[11] Patent Number: 4,718,140

[45] Date of Patent: Jan. 12, 1988

[54] FIREPLACE BLOWER AND VACUUM

[76] Inventor: Henry Johnson, R.R. 1 2076 Lucas Rd., Blanchester, Ohio 45107

[21] Appl. No.: 837,797

[22] Filed: Mar. 10, 1986

[51] Int. Cl.[4] ..... A47L 5/14

[52] U.S. Cl. ..... 15/330; 15/344; 15/405

[58] Field of Search ..... 15/345, 346, 341, 330

[56] References Cited

U.S. PATENT DOCUMENTS

| | | | |
|---|---|---|---|
| 1,034,597 | 8/1912 | Duryea | 15/341 X |
| 1,818,282 | 8/1931 | Soss | 15/330 |
| 2,024,367 | 1/1931 | Eriksson-Jons | 15/330 |
| 2,070,689 | 2/1937 | Smellie | 15/330 |
| 2,500,832 | 3/1950 | Kirby | 15/330 X |
| 2,969,559 | 9/1959 | Landis | 15/330 |
| 3,416,514 | 4/1967 | Klemme | 126/242 |

*Primary Examiner*—Chris K. Moore

*Attorney, Agent, or Firm*—Wood, Herron & Evans

[57] ABSTRACT

A combination vacuum cleaner and blower is described which is particularly adapted for use as an accessory to a fireplace. The apparatus of this invention is a portable hand-held vacuum/blower which is controlled by a reversible fan motor. When operating in a first direction, air is sucked into the vacuum preferably to clean up ashes around the fireplace. A valve is provided to prevent air from being sucked in the blower. When operated in a second direction air is blown out the blower exhaust and can be used to blow air on a fire. A second valve is provided to prevent air from being blown out of the vacuum inlet.

8 Claims, 4 Drawing Figures

FIREPLACE BLOWER AND VACUUM

BACKGROUND OF THE INVENTION

The present invention relates to a fireplace or woodburning stove accessory.

More particularly the present invention relates to a device adapted to assist in starting fires by blowing air on smoldering coals.

Further, the present invention relates to an apparatus to assist in cleaning ashes from around the fireplace wherein the ashes may still be hot or smoldering.

The present invention relates to a combination vacuum cleaner and blower designed especially for use around the fireplace.

Fireplaces and woodburning stoves are currently very much in vogue. For various reasons, it is often difficult to start a fire or to restart a smoldering fire. Typically the solution to this problem is to blow air into the smoldering fire. This is the purpose of the bellows used since ancient times. Fireplaces and woodburning stoves are also very dirty. Ashes created by fireplaces often are blown or pulled out of the fireplace and rest on the hearth and surrounding area. Bark and debris from firewood also adds to the mess. For this reason it would be very helpful to have a vacuum cleaner, especially adapted for a fireplace, one particularly suitable for use with flammable material. There is also a need for a combination vacuum cleaner and blower for a fireplace. It must be portable and simple to operate, preferably operating by flipping an electrical switch as opposed to mechanical manipulation of valves and vacuum hoses.

There are vacuum cleaners which are especially adapted for fireplaces. For example, Klemme U.S. Pat. No. 3,416,514 discloses a vacuum cleaner for removing ashes from around a fireplace. It is a very large, awkward apparatus which is not portable and does not include any blower which can be used to start a fire.

Of course, all vacuum cleaners are inherently blowers since the air sucked in must be vented out. Several vacuums are particularly adapted to be used as either a vacuum cleaner or a blower. For example, Eriksson-Jons, U.S. Pat. No. 2,024,367 and Landis, U.S. Pat. No. 2,969,559 disclose such devices. However, again, these are somewhat awkward devices and switching from the vacuuming mode to the blowing mode cannot be accomplished quickly.

Since any portable device should be hand held it is also preferable that the vacuum and blowing action both operate from the same end of the apparatus. This permits the handle to be constructed at the opposite end of the apparatus and comfortably fit the individual's hand. If the blowing action came out of one end of the vacuum and the sucking came out of the opposite end you would not be able to provide such a molded handle.

SUMMARY OF THE INVENTION

The present invention overcomes these problems and provides a combination vacuum and blower for use around the fireplace. The apparatus includes an inlet and outlet both extending from the front portion of the apparatus. The vacuum pulls in dust and debris through the inlet and the blower blows air out of the outlet. Valves are provided in both the inlet and the outlet to permit operation of only the blower or the vacuum at any one time.

Further, the present invention provides for switching from a blowing mode to a vacuuming mode by a mere flipping of a switch to reverse the direction the fan motor. In one direction of rotation the fan blows air out the exhaust. The valve in the inlet prevents air from being blown out the inlet. In the opposite direction of rotation the fan pulls air through the vacuum inlet. The valve in the outlet prevents air from being sucked into the outlet.

This provides for a very simple combination vacuum and blower which, due to its simplicity, can be easily provided in a portable, hand-held model. Since the valves are provided in both the inlet and the outlet portion of the apparatus air is not sucked into the vacuum when the exhaust is operating. Further, since both the inlet and the outlet extend from the front portion of the apparatus, the handle of the apparatus, can be especially molded to fit an individual's hand.

These advantages, as well as others, and the detailed principles of the present invention, will be appreciated in light of the detailed description and drawings in which:

DETAILED DESCRIPTION

Figure 1:
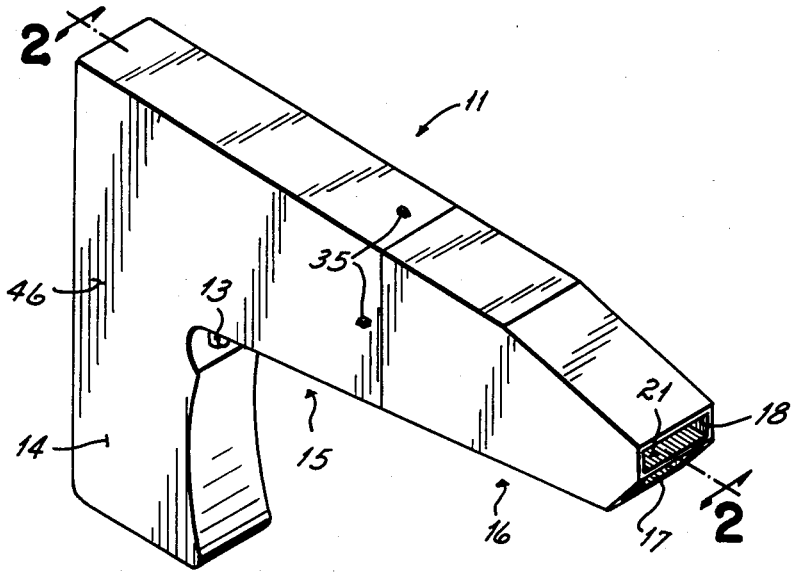
FIG. 1 is a perspective view of an apparatus according to present invention.
Figure 3:
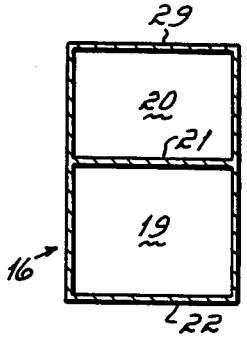
FIG. 3 is a cross-sectional view taken at lines 3—3 of FIG. 1.
Figure 2:
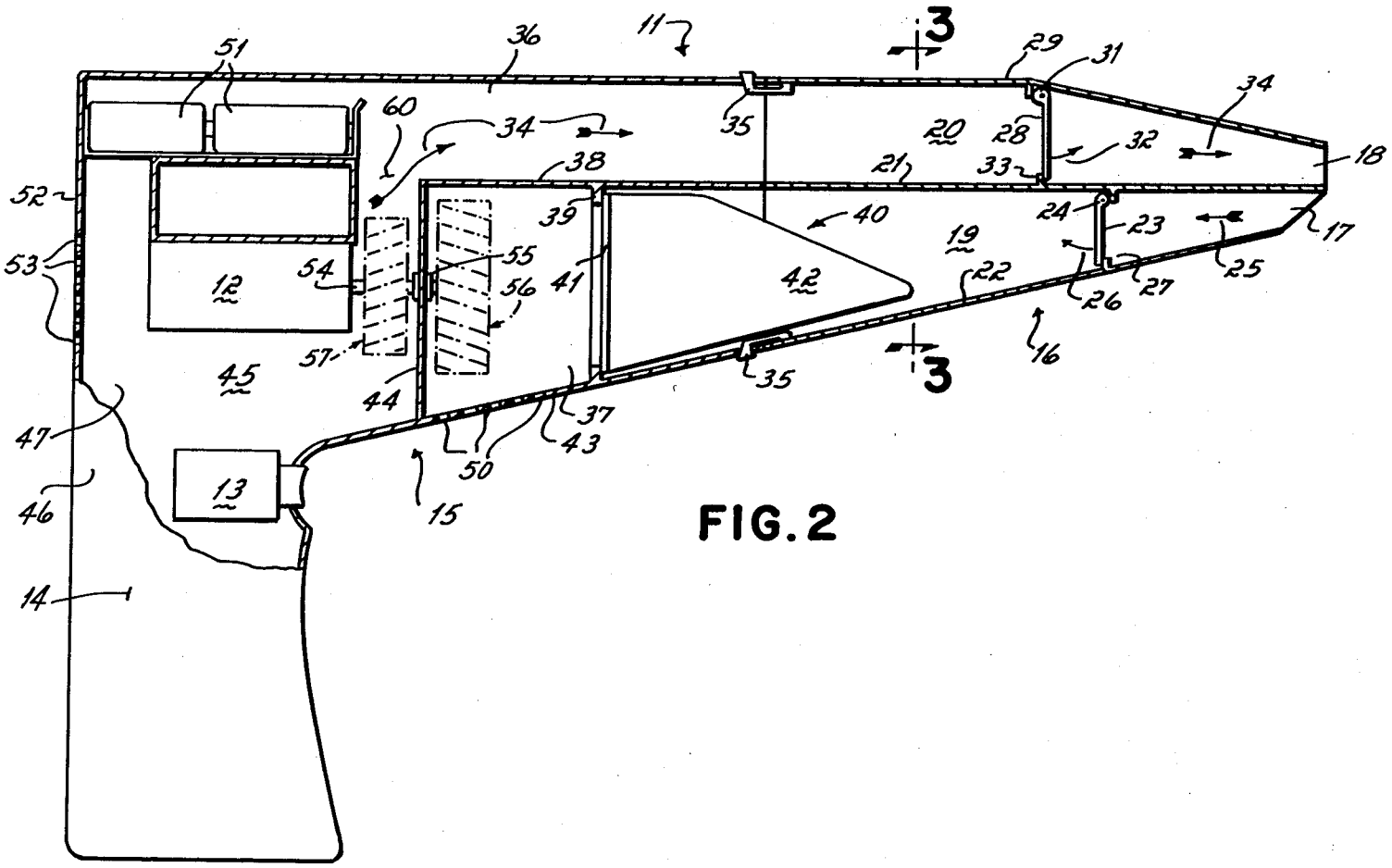
FIG. 2 is a cross-sectional view taken at line 2—2 of FIG. 1.

As shown in FIGS. 1 and 2 there is a combination vacuum blower apparatus 11 which is operated by a reversible motor 12 controlled by switch 13 in the handle 14 of the apparatus 11. The vacuum/blower 11 includes a rear portion 15 which includes the handle 14 and houses the switch 13 and motor 12. The front portion 16 includes a lower inlet 17 and an upper exhaust opening or outlet 18. The inlet 17, which is beveled as shown in FIG. 2 which leads into a first lower chamber 19 having a rectangular cross-section as shown in FIG. 3. The chamber leads to the vacuum filter as is discussed below. Exhaust opening 18 opens into an upper chamber 20 which leads to the blower of the apparatus 11 as in is also discussed below.

Chamber 19 includes a top wall 21 and a bottom wall 22. Top wall 21 separates upper and lower chambers 19 and 20. Extending from the top wall 21 is a plate 23 connected wall 21 by a hinge 24. The shape of this plate corresponds to the cross-sectional configuration of the chamber at its point of attachment and provides a valve to permit air to flow inwardly in the direction of arrow 25. More specifically, hinge 24 permits plate 23 to rotate only in the direction of arrow 26. The force of gravity will tend to direct the plate 23 downwardly where it will contact a bottom ledge 27 preventing it from rotating opposite the direction of arrow 26 beyond ledge 27.

The upper chamber 20 provides an air path for the exhaust portion of the apparatus 11. Like the lower chamber 19, upper chamber 20 also includes a plate 28 which is attached to a top wall 29 of chamber 20 by a hinge 31. Hinge 31 permits the plate 28 to rotate only in the direction of arrow 32. A bottom ledge 33 on wall 21 prevents the plate 28 from rotating in the direction opposite arrow 32 beyond ledge 33. Again, this plate 28 has a cross-sectional configuration corresponding the cross-sectional configuration of the chamber 20 at this location and provides a valve which permits air only to flow in the direction of arrow 34.

The front section 16 attaches to the rear section 15 of the apparatus 11 by a plurality of tabs 35 which extend from the front section 16 and snap into corresponding apertures in the back section 15.

The back section 15, like the front section, includes an upper exhaust chamber 36 and a lower vacuum chamber 37, separated by a common wall 38. Vacuum chamber 37 includes a annular ledge 39 which provides a base for supporting a vacuum bag 40. Vacuum bag 40 includes a frame 41 which supports the cone shaped filter 42 which rests on ledge 39. Preferably the filter 42 is formed from a fireproof material, such as fiber glass, ceramic or asbestos.

A lower wall 43 of chamber 37 includes a plurality of vent holes 50 which permit air to be exhausted from the vacuum chamber. The chamber 37 also includes a back wall 44 which prevents air from flowing from the chamber 37 to motor 12.

The exhaust chamber 36 communicates with a rearmost chamber 45. This rear chamber 45 houses the motor 12 mounted to the side walls 46 and 47 at motor mounts (not shown). Rear chamber 45 also houses the batteries 51 as well as the switch 13. The rearmost wall 52 of rear chamber 45 also includes an air inlet vent 53.

The motor 12 operates to alternately provide a sucking action for the vacuum through inlet opening 17 or a blowing action to blow air through outlet opening 18 and is controlled by switch 13. The motor 12 includes a drive shaft 54. Shaft 54 extends through a bearing 55 mounted in wall 44. Mounted on the shaft 54 in chamber 37 is a first centrifugal or radial flow fan 56. Mounted on the shaft 54 in chamber 45 is a second centrifugal or radial flow fan 57. Together fans 56 and 57 provide a fan means operated by reversible motor 12. Both fans include a plurality of blades bent in opposite directions one operable to blow air in one direction (relative to the front of the apparatus) when the shaft 54 rotates in a first direction and the second fan operable to blow air in the opposite direction (relative to the front of the apparatus) when the direction of rotation is reversed. Two fans are employed separated by wall 44 to prevent air from the vacuum chamber contacting the motor. Otherwise particles could be sucked in and could damage the motor. If a sealed motor were used, one fan with an appropriate axial blade structure could be employed and wall 44 would be eliminated. This would require only one opening for both the vacuum outlet and blower inlet.

Because of blade design, radial fans act to move air only when rotated in one direction. When a radial fan is rotated in an opposite direction, it moves very little air. Since the blades of fans 56 and 57 are slanted in opposite directions, only one fan moves air when the shaft rotates in a first direction. The other fan moves air when the shaft 54 rotates in the opposite direction. Therefore, this fan construction prevents air from passing out the inlet and prevents air from passing in the outlet.

The rearmost chamber 45 opens into upper exhaust chamber 36 at passage 60. This permits air to flow from vent 53 around motor 12 through chamber 45 to chamber 36 and finally out the exhaust opening 18 as shown by arrows 34.

Figure 4:
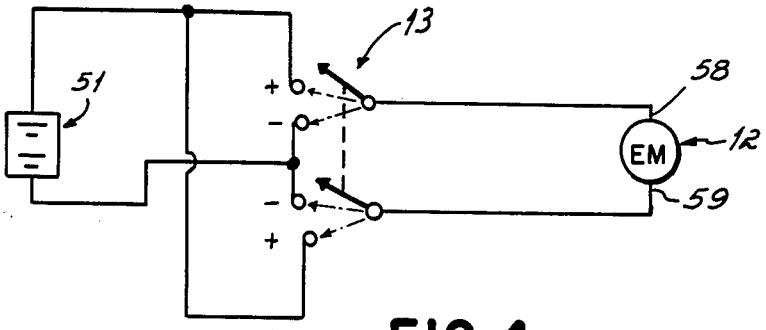
FIG. 4 is a circuit diagram.

FIG. 4 shows an electrical diagram for operation of the motor 12. Basically the diagram shows the batteries 51 connected to reversible switch 13 and in turn connected to the motor 12 at poles 58 and 59. As shown in the FIG. 4 the switch 13 is operable to reverse the polarity of the charge from the battery causing the motor to rotate in either a clockwise or counter-clockwise direction. The switch 13 can also deactivate the motor 12. The apparatus of the present invention could also be powered by a rechargeable battery pack built into the apparatus or by alternating current from a wall outlet. This latter alternate embodiment would require the use of a universal motor.

In operation, when the fan is operating in a first direction fans 56 and 57 are rotated in that first direction (for example, in a clockwise direction). In this first direction, air will be sucked inwardly into the apparatus 11 in the direction of arrows 25. This will create a negative pressure in chamber 19 and chamber 20. The negative pressure in chamber 20 will cause the plate 28 to rest against ledge 33 blocking inward air flow. The negative pressure in chamber 19 will cause plate 23 to rotate in the direction of arrow 26 permitting air to flow inwardly as is shown by arrow 25. The air will pass through the vacuum filter 42 into chamber 37 and exit through vacuum vent holes 50. Wall 44 prevents the air from being blown into rearmost chamber 45. The vacuum created can be used to suck up ashes from around the fireplace.

By reversing switch 13 the motor 12 will rotate shaft 54 in the opposite or second or counter-clockwise direction. This will cause air to be blown forwardly in the direction of arrows 34 from both fan 56 and 57. This will create a positive pressure in chambers 19 and 20. The positive pressure in chamber 19 will cause plate 23 to rest upon ledge 27 preventing air flow in that direction. The positive pressure in chamber 20 will cause the plate 28 to rotate in the direction shown of arrow 32 permitting air to flow outwardly through outlet 18. Thus, air will be blown by the second fan 57. Then air pulled inward from the rear vent 53 around the motor 12 through chamber 45 and passage 60 into chamber 36 into chamber 20 and out exhaust opening 18. This can be directed at a smoldering fire to help reignite it.

In a third position the switch will simply deactivate the motor by stopping connection from the poles to the battery. Accordingly, in operation the present apparatus 11 can be used as a hand-held blower to facilitate starting a fire by blowing air onto a smoldering fire. Likewise, by merely flipping a switch the apparatus can be employed to suck ashes up from around the fireplace. The entire apparatus is preferably made of fireproof materials. Particularly the front section which may contact smoldering debris and should be metal or other fireproof materials.

This hand-held vacuum and blower provides a very convenient and simple device or accessory for use with a fireplace.

Accordingly, having described my invention, and many of its advantages and uses, I claim:

1. An apparatus adapted to alternately, but not concurrently, exhaust air and create a vacuum comprising:

a front portion including an inlet leading into a vacuum chamber and an outlet extending from an exhaust chamber;

said vacuum chamber including a valve adapted to permit air to flow into and not out of said inlet said chamber further including a filter;

said exhaust chamber including a valve adapted to permit air to flow out of and not into said exhaust chamber;

fan means mounted within said apparatus and operated by a reversible motor;

said fan means operable to suck air into said vacuum chamber through said filter when rotated by said motor in a first direction;

said fan means further operable to blow air through said exhaust chamber out of said outlet when rotated by said motor in a second direction.

2. An apparatus adapted to alternately exhaust air and create a vacuum comprising:

a front portion and a back portion, said front portion having an inlet and an outlet, a first centrifugal fan adapted to suck air into said inlet when rotated in a first direction;

means to filter air sucked into said inlet;

a second centrifugal fan adapted to blow air out said outlet when rotated in a second direction;

means to rotate said first fan in said first direction;

means to rotate said second fan in said second direction;

wherein said means to rotate said first fan in said first direction comprises a reversible motor rotating in a first direction; and wherein said means to rotate said second fan in a second direction comprises said reversible motor rotating in a second direction;

said apparatus further comprising means to alternate the direction of rotation of said motor.

3. The apparatus claimed in claim 2 further comprising a first chamber extending from said inlet to said means to filter air; and means to prevent air from exiting said inlet comprising a plate hingedly attached to a top wall of said first chamber and adapted to block said chamber when air pressure outside of said chamber is not greater than the air pressure within said chamber.

4. The apparatus claimed in claim 3 comprising a second chamber leading to said outlet;

means to prevent air from entering said second chamber through said outlet.

5. The apparatus claimed in claim 2 wherein said means to filter air comprises a fireproof filter.

6. An apparatus adapted to alternately exhaust air and create a vacuum comprising:

a front portion and a back portion, said front portion having an inlet and an outlet, means to suck air into said inlet comprising a motor rotating a first fan in a first direction;

means to prevent air from passing out said inlet;

means to filter air sucked into said inlet;

means to blow air out of said outlet comprising said motor rotating a second fan in a second direction;

means to alternate the direction of said motor;

a first chamber extending from said inlet to said means to filter air and a second chamber extending from said means to blow air to said outlet;

means to direct air sucked through said first chamber to said first fan thereby sucking air into said inlet when said first fan is rotated in said first direction; and means to direct air blown by said second fan through said second chamber to said outlet when said second fan is rotated in said second direction.

7. The apparatus claimed in claim 6 wherein said means to prevent air from passing out said inlet comprises a plate hingedly attached to a top wall of said first chamber and adapted to block said chamber when air pressure outside of said chamber is not less than the air pressure within said chamber.

8. The apparatus claimed in claim 7 wherein said means to filter air comprises a fireproof filter.

* * * * *